US010215545B2

(12) United States Patent
Winter et al.

(10) Patent No.: US 10,215,545 B2
(45) Date of Patent: Feb. 26, 2019

(54) ELECTROMECHANICAL PRIMER CAP

(71) Applicant: RUAG Ammotec GmbH, Fürth (DE)

(72) Inventors: Andreas Winter, Fürth (DE); Wolfgang Mosig, Hartmannshof (DE); Ulrich Bley, Fürth (DE); Aleksej Hoschenko, Fürth (DE)

(73) Assignee: RUAG AMMOTEC GMBH, Furth (DE)

( * ) Notice: Subject to any disclaimer, the term of this patent is extended or adjusted under 35 U.S.C. 154(b) by 0 days.

(21) Appl. No.: 14/910,022

(22) PCT Filed: Aug. 5, 2014

(86) PCT No.: PCT/EP2014/066818
§ 371 (c)(1),
(2) Date: Feb. 4, 2016

(87) PCT Pub. No.: WO2015/018829
PCT Pub. Date: Feb. 12, 2015

(65) Prior Publication Data

US 2016/0169651 A1 Jun. 16, 2016

(30) Foreign Application Priority Data

Aug. 5, 2013 (DE) ..... 10 2013 012 911

(51) Int. Cl.
*F42C 19/14* (2006.01)
*F42B 3/12* (2006.01)

(52) U.S. Cl.
CPC ..... *F42C 19/14* (2013.01); *F42B 3/12* (2013.01)

(58) Field of Classification Search
CPC ..... F42C 19/14; F42B 3/12
(Continued)

(56) References Cited

U.S. PATENT DOCUMENTS 712,826 A * 11/1902 Mason ..... F42C 19/14 102/202.6
2,972,951 A * 2/1961 Stresau ..... F42B 3/124 102/202.9

(Continued)

FOREIGN PATENT DOCUMENTS

DE 19 35 376 A1 2/1971
DE 23 64 272 A1 6/1975

(Continued)

OTHER PUBLICATIONS

International Search Report for PCT/EP2014/066818 dated Nov. 11, 2014; English Translation submitted herewith (8 pages).

*Primary Examiner* — Stephen Johnson
*Assistant Examiner* — Benjamin S Gomberg
(74) *Attorney, Agent, or Firm* — Fitch, Even, Tabin & Flannery, LLP

(57) ABSTRACT

The invention relates to an electromechanical primer cap, having an explosive mixture for the selective electrical or mechanical initiation of the explosive mixture, having an outer metal cup, and electrically conductive pole piece, a firing bridge support body made of an electrically insulating material, with a through-bore, on the upper side of which a firing bridge is arranged, and having a counter surface placed onto the explosive mixture, wherein a hole through which the pole piece protrudes is constructed in the vase of the metal cup. A portion of the explosive mixture lies on a contact surface of the pole piece, and the counter surface protrudes as far as the through-bore of the firing bridge support body, or into or through the bore, and continues to just above the contact surface.

8 Claims, 2 Drawing Sheets

(58) Field of Classification Search
USPC ..... 102/202.7
See application file for complete search history.

(56) References Cited

U.S. PATENT DOCUMENTS 3,363,563 A * 1/1968 Eckstein ..... F42C 19/10 102/470
3,577,923 A * 5/1971 Perkins ..... F42B 5/36 102/202.1
3,682,096 A * 8/1972 Ludke ..... F42C 19/12 102/202.9
3,719,148 A * 3/1973 Gawlick ..... F42C 19/0815 102/202.6
3,768,413 A * 10/1973 Ramsay ..... F42C 19/14 102/202.6
3,844,216 A * 10/1974 Jakobs ..... F42C 19/14 102/202.6
3,867,885 A * 2/1975 Gawlick ..... F42C 19/12 102/202.9
4,014,264 A * 3/1977 Bendler ..... F42B 3/125 102/202.6
4,267,567 A * 5/1981 Nygaard ..... F42B 3/124 102/202.5
4,329,924 A * 5/1982 Lagofun ..... F42C 19/12 102/202.8
4,386,567 A * 6/1983 Ciccone ..... F42C 19/14 102/202.5
4,464,990 A * 8/1984 Bendler ..... F42C 19/10 102/204
4,881,463 A * 11/1989 Ninio ..... F42C 19/12 102/202.2
6,598,532 B2 * 7/2003 Gerard ..... F42C 19/14 102/202.14
2003/0033951 A1 2/2003 Gerard et al.
2016/0161237 A1 * 6/2016 Winter ..... F42C 19/12 102/202.7

FOREIGN PATENT DOCUMENTS

DE 24 43 793 A1 3/1976
GB 965 413 A 7/1964

* cited by examiner

ELECTROMECHANICAL PRIMER CAP

CROSS-REFERENCE TO RELATED APPLICATIONS

This application is a U.S. national phase application filed under 35 U.S.C. § 371 of International Application No. PCT/EP2014/066818, filed Aug. 5, 2014, designating the United States, which claims priority from German Patent Application No. 10 2013 012 911.7, filed Aug. 5, 2013, which are hereby incorporated herein by reference in their entirety for all purposes.

The invention relates to an electromechanical primer cap, i.e., a primer cap having an explosive mixture for the selective electrical or mechanical initiation of the explosive mixture—having an outer metal cup, an electrically conductive pole piece, a firing bridge support body made of an electrically insulating material, with a through-bore, on the upper side of which a firing bridge is arranged, and having a counter surface placed onto the explosive mixture, wherein a hole through which the pole piece protrudes is constructed in the base of the metal cup, and the pole piece is electrically connected to a second pole of the firing bridge, and the first pole of the firing bridge is electrically coupled to the metal cup.

PRIOR ART

Two classes of primer caps (ANZDHs) exist for the initiation of various types of ammunition and also other pyrotechnical elements: mechanically triggered and electrically triggered. The mechanical ANZDHs are simple containers which are filled with an explosive mixture and optionally contain a counter surface is the form of an anvil (in some ANZDHs, this counter surface is situated in the cartridge case). To trigger the cap, a firing pin strikes the base of the ANZDH and rapidly compresses it in such a way that the explosive substance is squeezed between the deformed base and the contact surface, and initiates its chemical reaction.

In electrical ANZDHs, electrical energy is converted into heat. Once the deflagration temperature has been reached, the chemical reaction of the explosive substance begins. The heat is generated by a simple ohmic resistor (such as a heating wire). The functionalities of the two classes are therefore distinctly different. Due to their simplicity, mechanical ANZDHs are small enough to be able to be used in small-caliber ammunition. Electrical ANZDHs are generally larger than mechanical ANZDHs due to the additional need for insulation and the ohmic resistor, and therefore are not typically suited for use in small-caliber ammunition.

A generic electromechanical primer cap is known from DE 2 364 272 A1, and can be initiated mechanically by the strike of a firing pin, as well as by the application of electric voltage and the resulting flow of current. However, it is disadvantageous in this electromechanical primer cap that, in principle, two separate primer caps are installed in a common housing, which results in the overall system becoming very large and/or very long.

The object of the invention is to refine an electromechanical primer cap in such a manner that it has approximately the dimensions of a classical mechanical primer cap, such that it can be used in small-caliber ammunition.

This object is achieved according to the invention by an electromechanical primer cap having an explosive mixture for the selective electrical or mechanical initiation of the explosive mixture. The primer cap has an outer metal cup, an electrically conductive pole piece, a firing bridge support body made of an electrically insulating material, with a through-bore, on the upper side of which a firing bridge is arranged, and a counter surface placed onto the explosive mixture. A hole through which the pole piece protrudes is constructed in the base of the metal cup, and the pole piece is electrically connected to a second pole of the firing bridge, and the first pole of the firing bridge is electrically coupled to the metal cup. A portion of the explosive mixture lies on a contact surface of the pole piece, and the counter surface protrudes as far as the through-bore or the firing bridge support body, or into or through the bore, and continues to just above the contact surface.

Because a portion of the explosive mixture lies on a contact surface of the pole piece, and the counter surface protrudes as far as the through-bore of the firing bridge support body, or into or through the same, and continues to just above the contact surface, the electromechanical primer cap according to the invention has approximately the same dimensions as a classical mechanical primer cap.

This shortening of the installation height is achieved by using the pole piece as an electrical connector element as in the prior art, but additionally using it as an impact surface for a firing pin. This is made possible, on the one hand, by the fact that a portion of the explosive mixture lies on the contact surface of the pole piece, and the counter surface continues until just above the contact surface. In this way, the distance between the counter surface and the pole piece is minimized, resulting in the low installation height. In contrast to the prior art, the explosive mixture is shifted much farther downward towards the base of the metal cup. A large region of the installation height is filled in by the counter surface.

In one preferred embodiment, the counter surface has a point, and the inner shell surface of the through-bore in the firing bridge support body encompasses the point of the counter surface, with a spacing therefrom. The firing bridge support body therefore does not require any additional installation height because it does not increase the distance between the counter surface and the contact surface.

The pole piece has a disk shape and comprises two planes offset with respect to each other in height, wherein the first plane forms the contact surface for the explosive mixture, and the second plane encompasses the point of the counter surface with a height offset with respect to the first plane, forming a contact area for the firing bridge support body. The pole piece consequently has an extremely flat construction without restricting functionality. Because the first plane projects into the hole in the base of the metal cup, the utilized installation height of the pole piece is the thickness of the second plane.

The counter surface is preferably an anvil, and the point is preferably a funnel-shaped anvil point. Anvils are sufficiently resistant to deformation and are well-suited as a counter surface.

A metallic inner shell is advantageously inserted into the metal cup, pressing the firing bridge support body onto the contact area of the pole piece, and electrically coupling the first pole of the firing bridge to the metal cup. The inner shell is beveled by 90° on its end which faces the firing bridge support body, thereby forming a flat surface which presses onto the contact area of the pole piece.

The anvil preferably lies flush with the inner shell, and is advantageously designed with three wings. In addition, the anvil is advantageously designed with vent openings for the ignition gases.

In one embodiment of the invention, the underside and the through-bore of the firing bridge support body are metallized and electrically connected to each other, and a metallic edge contact is arranged on the edge of the upper side and connected to the first pole of the firing bridge, and the second pole of the firing bridge is connected to the metallizing of the through-bore. Such firing bridge support bodies are known per se.

The electromechanical primer cap according to the invention is preferably used for small-caliber ammunition.

The invention is described below in greater detail with reference to the figures.

Figure 1:
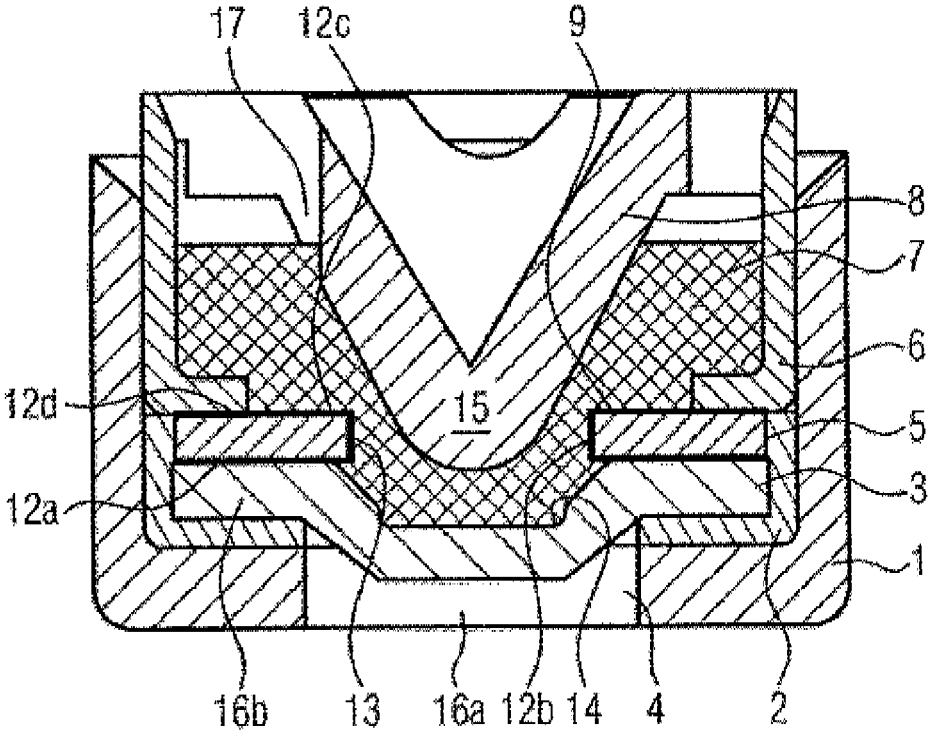
FIG. 1 shows a cross-sectional view of an electromechanical primer cap according to the invention.

The primer cap (ANZDH) is constructed in such a manner that the user has the choice of how to initiate the ANZDH. Each ANZDH offers in parallel the option of an electrical or mechanical initiation.

A metal cup 1 is used to accommodate all components. Insulation 2 and a pole piece 3 made of metal are positioned on the base thereof, and said pole piece projects into a hole 4 in the base of the cup 1. The pole piece 3 and the metal cup 1 form the two electrical contacts for the electrical initiation. The pole piece 3 also simultaneously forms the impact surface for a firing pin (not shown here) during the mechanical initiation. A firing bridge support body 5 is positioned over the pole piece 3, constructed as a thin ring of an electrically insulating material, wherein a firing bridge 9 is attached thereto as an ohmic resistor (see below), A metallic inner shell 6 fixes, on the one hand, the insulation 2, the pole piece 3 and the firing bridge support body 5 on the base of the metal cup 1, and on the other hand the inner shell 6 establishes an electrical contact between the metal cup 1 and the upper side of the firing bridge support body 5.

Figure 2:
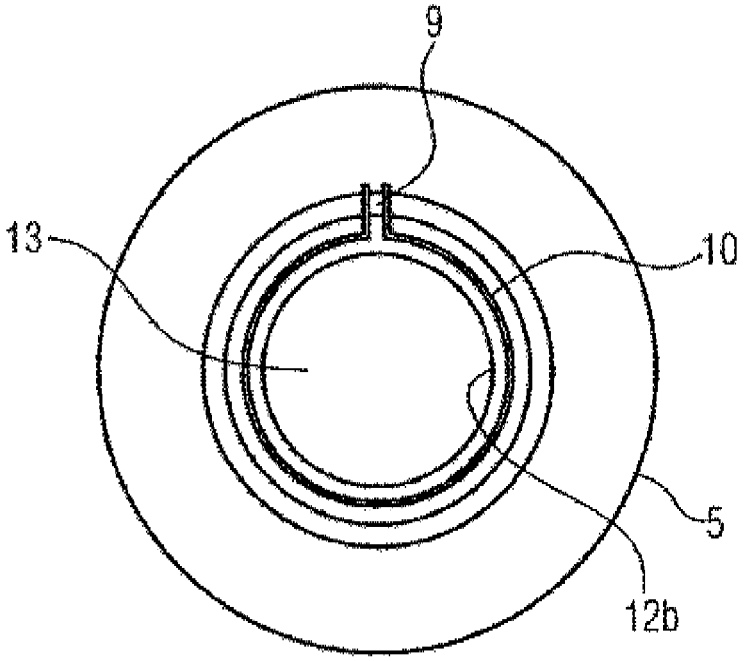
FIG. 2 shows a top view of the firing bridge support body 5 in FIG. 1.

The inner shell 6 has a relatively large hole in the base, and has contact with the firing bridge support body 5 only on the upper edge thereof. The inner space of the inner shell 6 is filled with an explosive mixture 7. A counter surface 8—in this case an anvil—is placed on the top of this explosive mixture 7, and closes off the inner shell 6 and/or projects slightly beyond the same. The counter surface 8 in this case is shown as an anvil, but can also be replaced by a corresponding counter surface of similar shape in the cartridge case. An important constructive feature is the elongated shape of the counter surface 8, which ensures a slight spacing between the point 15 of the counter surface 8 and the pole piece 3. This slight spacing is necessary for a reliable mechanical initiation. For the electrical initiation, the firing bridge support body 5 (see FIG. 2 as well) is of decisive importance: the base material thereof is not conductive. The outer shell surface of the firing bridge support body 5 is free of conductive surface coatings and functions as an insulator. The base surface 12*a* of the firing bridge support body 5, the inner shell surface 12*b* of the through-bore 13 in the firing bridge support body 5, and the inner portion 12*c* and outer portion 12*d* of the upper surfaces have been made conductive using a coating (e.g., by gold plating). An annular region 10 is positioned as insulation on the upper side (see FIG. 2). This is achieved, by way of example, by removing the coating in this region such that the insulating base material is exposed once more. An ohmic resistor is attached at a point of this annular insulation (see FIG. 2) as a firing bridge 9, preferably as a narrow film of conductive material, which establishes electrical contact between the outer portion 12*d* of the upper side of the firing bridge support body 5 and the inner portion 12*c* with the through bore 13. In this way, an electric current can flow when a voltage is applied to the metal cup 1 and the pole piece 3, specifically, through the pole piece 3 into the underside of the firing bridge support body 5, via the inner shell surface 12*b* of the through-bore 13, to the upper side of the firing bridge support body 5, via the narrow contact strip and/or the firing bridge 9, to the outer upper side, i.e., edge contact, of the firing bridge support body 5, to the inner shell 6, and finally to the metal cup 1. Because the thickness of the film at the contact point, i.e., the firing bridge 9, is very low, and the contact is also very narrow, the thin film has a relatively high electrical resistance compared to the rest of the primer cap (which, nonetheless, typically lies in the single-digit ohm range). When current flows, the film and the explosive substance 7 thereon are heated to above the deflagration temperature, and the initiation occurs.

An essential feature of the invention is that at least a portion of the explosive mixture 7 lies on a contact surface 14 of the pole body 3. It is thus ensured that the initiation results when the explosive mixture 7 is squeezed between the contact surface 14 and the point 15 of the counter surface 8 during the mechanical initiation.

The counter surface 8—in this case the anvil—is typically used in a three-winged design (however, other versions can be contemplated), which does not appear to be symmetrical in the cross-section in FIG. 1 because, at the left, one of the openings has been cut by the cross section, as has one of the wings at the right. A parabolic line can be seen in the background of the image, which illustrates one of the vent openings 17 between the wings. Ignition gases can escape upwardly through these vent openings 17 between the wings of the anvil to reach and ignite propellant powder in a cartridge.

Figure 3:
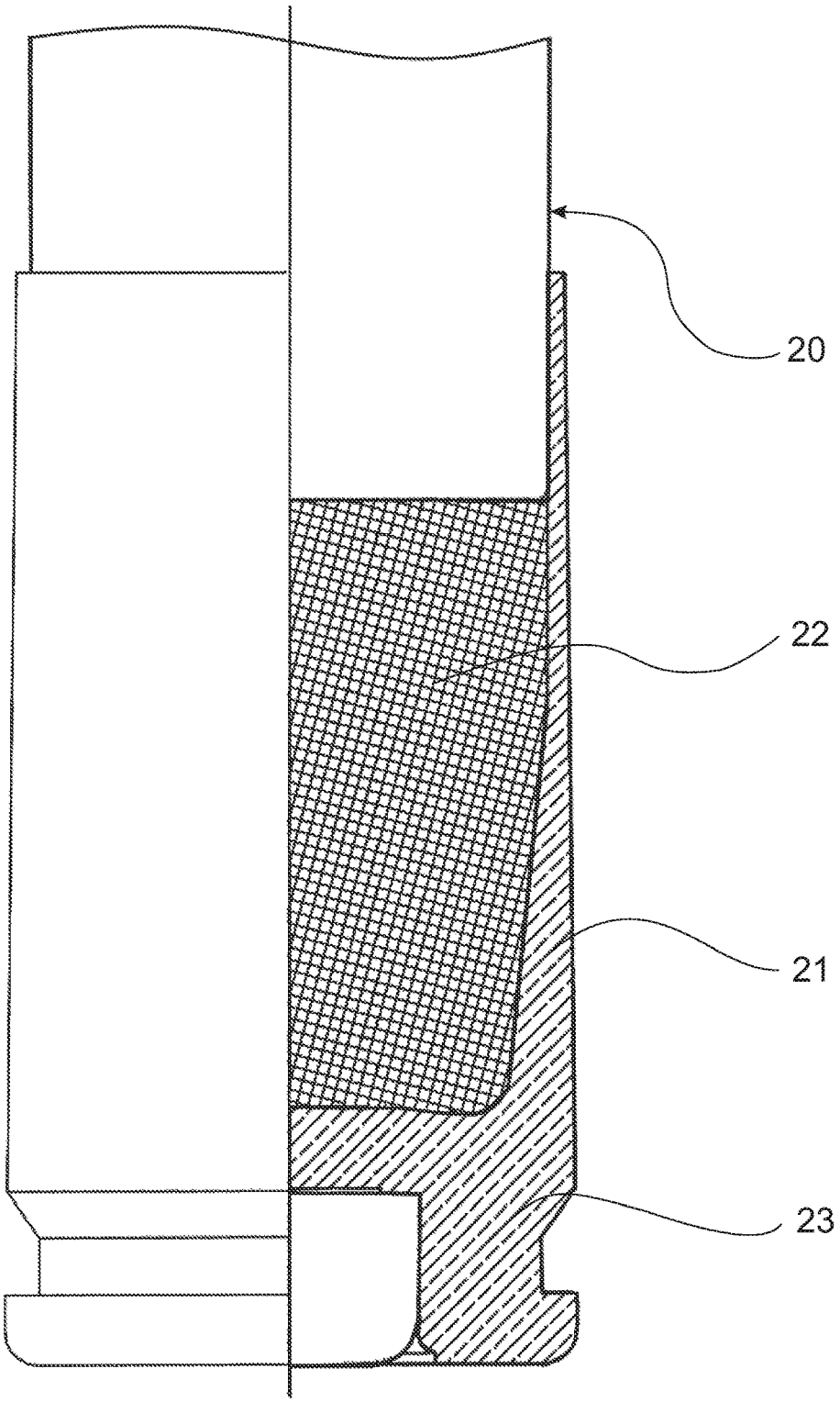
FIG. 3 shows small-caliber ammunition comprising the primer cap according to the invention.

FIG. 3 shows small-caliber ammunition 20 including a cartridge 21, propellant powder 22 in the cartridge 21, and a primer cap 23. The primer cap of the present can be used as the primer cap 23 of the small-caliber ammunition, the primer cap 23 being connected to the propellant powder 22 in the cartridge.

The invention claimed is:

1. An electromechanical primer cap, which may be selectively initiated electrically or mechanically, comprising:

an outer metal cup having a cylindrical sidewall extending in an axial direction and a base having upper and lower major surfaces extending at an angle from the axial direction, the base being provided with a hole therethrough extending in the axial direction through the base from the upper major surface of the base to the lower major surface of the base, an electrically conductive pole piece having a portion projecting into the hole in the base of the outer metal cup, an explosive mixture provided within the outer metal cup, a firing bridge support body made of an electrically insulating material having a ring shape having upper and lower major surfaces extending in a radial direction perpendicular to the axial direction and having a through-bore extending in the axial direction through the firing bridge support body from the upper major surface to the lower major surface, and comprising a firing bridge arranged on the upper major surface of the firing bridge support body, the firing bridge having first and second poles, wherein the pole piece is electrically connected to the second pole of the firing bridge, and the first pole of the firing bridge is electrically connected to the metal cup, and a counter surface placed onto the explosive mixture, wherein the counter surface protrudes downwardly in the axial direction such that a lower surface of the counter surface is level with the upper major surface of the firing bridge support body, or into the through-bore of the firing bridge support body or through the through-bore of the firing bridge support body, and continues towards an upper contact surface of the electrically conductive pole piece to provide a spacing between the lower surface of the counter surface and the upper contact surface of the electrically conductive pole piece in which a portion of the explosive mixture is provided contacting the lower surface of the counter surface and the upper contact surface of the electrically conductive pole piece, the spacing being configured to allow mechanical initiation of the explosive mixture.

2. The primer cap according to claim 1, wherein the counter surface has a point and an inner shell surface of the through-bore in the firing bridge support body encompasses the point of the counter surface with a spacing therefrom.

3. The primer cap according to claim 2, wherein the pole piece has a disk shape and comprises two planes offset with respect to each other in height, wherein the first plane forms the upper contact surface for the explosive mixture, and the second plane encompasses the point of the counter surface with a height offset with respect to the first plane, forming a contact area for the firing bridge support body.

4. The primer cap according to claim 3, wherein a metallic inner shell is inserted into the metal cup, pressing the firing bridge support body onto the contact area of the pole piece, and electrically coupling the first pole of the firing bridge to the metal cup.

5. The primer cap according to 4, wherein the counter surface is an anvil and the point is a funnel-shaped anvil point, the anvil is flush with the inner shell and has vent openings for ignition gases.

6. The primer cap according to claim 2, wherein the counter surface is an anvil and the point is a funnel-shaped anvil point.

7. The primer cap according to claim 1, wherein the lower major surface of the firing bridge support body and the through-bore of the firing bridge support body are provided with a metal layer and electrically connected to each other, and a metallic edge contact is arranged on an edge of the upper major surface of the firing bridge support body, and is electrically connected to the first pole of the firing bridge, and the second pole of the firing bridge is connected to the metal layer provided in the through-bore.

8. Small-caliber ammunition comprising: a cartridge, propellant powder in the cartridge, and a primer cap according to claim 1 operably connected to the propellant powder in the cartridge.

* * * * *